US009574506B2

(12) United States Patent
Hattori et al.

(10) Patent No.: US 9,574,506 B2
(45) **Date of Patent: *Feb. 21, 2017**

(54) ENGINE STARTING DEVICE OF IDLE REDUCTION VEHICLE

(71) Applicant: NISSAN MOTOR CO., LTD., Yokohama-shi, Kanagawa (JP)

(72) Inventors: Motoyuki Hattori, Atsugi (JP); Yuuichi Hosaka, Kawasaki (JP); Masaya Furushou, Yokohama (JP); Toshihiko Ootsuka, Atsugi (JP); Hiromoto Shimizu, Yokohama (JP); Ryo Sano, Kawasaki (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 274 days.

This patent is subject to a terminal disclaimer.

(21) Appl. No.: 14/379,112

(22) PCT Filed: Feb. 5, 2013

(86) PCT No.: PCT/JP2013/052616

§ 371 (c)(1),
(2) Date: Aug. 15, 2014

(87) PCT Pub. No.: WO2013/125343

PCT Pub. Date: Aug. 29, 2013

(65) Prior Publication Data

US 2015/0027405 A1 Jan. 29, 2015

(30) Foreign Application Priority Data

Feb. 22, 2012 (JP) ..... 2012-035818

(51) Int. Cl.
*F02D 31/00* (2006.01)
*F02N 11/00* (2006.01)
*F02N 11/08* (2006.01)

(52) U.S. Cl.
CPC ..... *F02D 31/001* (2013.01); *F02N 11/087* (2013.01); *F02N 11/0814* (2013.01); *F02N 2250/02* (2013.01); *F02N 2300/2002* (2013.01)

(58) Field of Classification Search
CPC ..... F02N 11/00
(Continued)

(56) References Cited

U.S. PATENT DOCUMENTS 5,731,638 A 3/1998 Niimi
2004/0168664 A1 9/2004 Senda et al.
(Continued)

FOREIGN PATENT DOCUMENTS

CN 101832209 A 9/2010
JP 2000-134707 A 5/2000
(Continued)

OTHER PUBLICATIONS

Japanese International Preliminary Report on Patentability, PCT/IPEA/409, Aug. 1, 2014, 6 pages.

*Primary Examiner* — Robert Deberadinis
(74) *Attorney, Agent, or Firm* — Foley & Lardner LLP

(57) ABSTRACT

A current is supplied to a driving relay that drives a bypass relay when restarting an engine after idle reduction, and the current supply to the driving relay is interrupted when the engine is started for the first time based on operation of a driver.

2 Claims, 6 Drawing Sheets

(58) Field of Classification Search
USPC ..... 307/10.8, 10.6
See application file for complete search history.

(56) References Cited

U.S. PATENT DOCUMENTS

| | | | |
|---|---|---|---|
| 2005/0253393 | A1 | 11/2005 | Senda et al. |
| 2007/0115604 | A1 | 5/2007 | Zettel et al. |
| 2009/0108674 | A1 | 4/2009 | Ozaki et al. |
| 2009/0228163 | A1 | 9/2009 | Tarchinski |
| 2011/0095545 | A1 | 4/2011 | Nakayama et al. |
| 2011/0128662 | A1 | 6/2011 | Kato et al. |
| 2011/0196570 | A1 | 8/2011 | Nakamura |
| 2011/0213525 | A1 | 9/2011 | Kanemoto et al. |
| 2011/0221210 | A1 | 9/2011 | Suzuki |
| 2012/0032453 | A1 | 2/2012 | Nakamura |
| 2012/0119516 | A1 | 5/2012 | Connelly et al. |
| 2012/0162847 | A1 | 6/2012 | Suzuki et al. |
| 2012/0191294 | A1 | 7/2012 | Boiron et al. |
| 2012/0200093 | A1 | 8/2012 | Venkatasubramaniam et al. |
| 2012/0216768 | A1 | 8/2012 | Nakamura |
| 2012/0318227 | A1 | 12/2012 | Hashimoto et al. |
| 2013/0009648 | A1 | 1/2013 | Tae |
| 2014/0372013 | A1* | 12/2014 | Shimizu ..... F02N 11/08 701/112 |
| 2015/0175103 | A1 | 6/2015 | Yamazaki |
| 2015/0210271 | A1 | 7/2015 | Yamazaki |

FOREIGN PATENT DOCUMENTS

| | | | |
|---|---|---|---|
| JP | 2004-257369 | A | 9/2004 |
| JP | 2006-081340 | A | 3/2006 |
| JP | 2008-301612 | A | 12/2008 |
| JP | 2009-068426 | A | 4/2009 |
| JP | 2011-014282 | A | 1/2011 |
| JP | 2011-185260 | A | 9/2011 |
| WO | WO-2011/158088 | A2 | 12/2011 |

* cited by examiner

ENGINE STARTING DEVICE OF IDLE REDUCTION VEHICLE

TECHNICAL FIELD

The present invention relates to an engine starting device of an idle reduction vehicle.

BACKGROUND ART

The idle reduction vehicle has a possibility of power shutdown of electronic parts due to a voltage drop of a battery, when restarting an engine after idle reduction. The power shutdown of the electronic parts while an ignition switch is on gives uncomfortable feeling to a driver.

In response to the above, Patent document 1 discloses a technique of suppressing the voltage drop of the battery at the time of starting the engine by interposing a rush current suppression circuit, in which a resistor and a bypass relay are connected in parallel, between a battery and a starter motor, and by closing a normally open contact of the bypass relay after a lapse of a predetermined period of time after starting the engine.

RELATED ART DOCUMENT

Patent Document

Patent document 1: JP2004-257369A

SUMMARY OF INVENTION

Technical Problem

According to the above conventional technique, however, there is a possibility that the resistor is burnt out due to a large current flow through the resistor over a long period of time, when the bypass relay is stuck open due to a failure of a control means for controlling opening/closing of the bypass relay.

It is an object of the present invention to provide an engine starting device of an idle reduction vehicle that can prevent both of power shutdown of the electronic parts and burning out of the resistor, when restarting the engine after the idle reduction.

Solution to Problem

According to the present invention, a current for energizing the bypass relay is supplied to the control means when restarting the engine after the idle reduction, and the current supply to the control means is interrupted when the engine is started for the first time based on operation by a driver.

Advantageous Effects of Invention

According to the present invention, the current supply to the control means is interrupted when the engine is started for the first time based on the operation by the driver. Even when the bypass relay is to be energized because of a failure of the control means, the current is not supplied to the bypass relay. Thus, the bypass relay maintains a closed state and the resistor is short-circuited, which makes it possible to prevent burning out of the resistor.

Meanwhile, when the engine is restarted after the idle reduction, the current is supplied to the control means. Therefore, when the bypass relay is to be energized because of the failure of the control means, the current is actually supplied to the bypass relay. As the bypass relay maintains an open state at this time, the current is supplied from the battery via the resistor to the starter motor, which makes it possible to prevent the power shutdown of the electronic parts due to the voltage drop of the battery.

As a result of this, it is possible to prevent both of the power shutdown of the electronic parts and the burning out of the resistor when restarting the engine after the idle reduction.

REFERENCE SIGNS LIST

Figure 1:
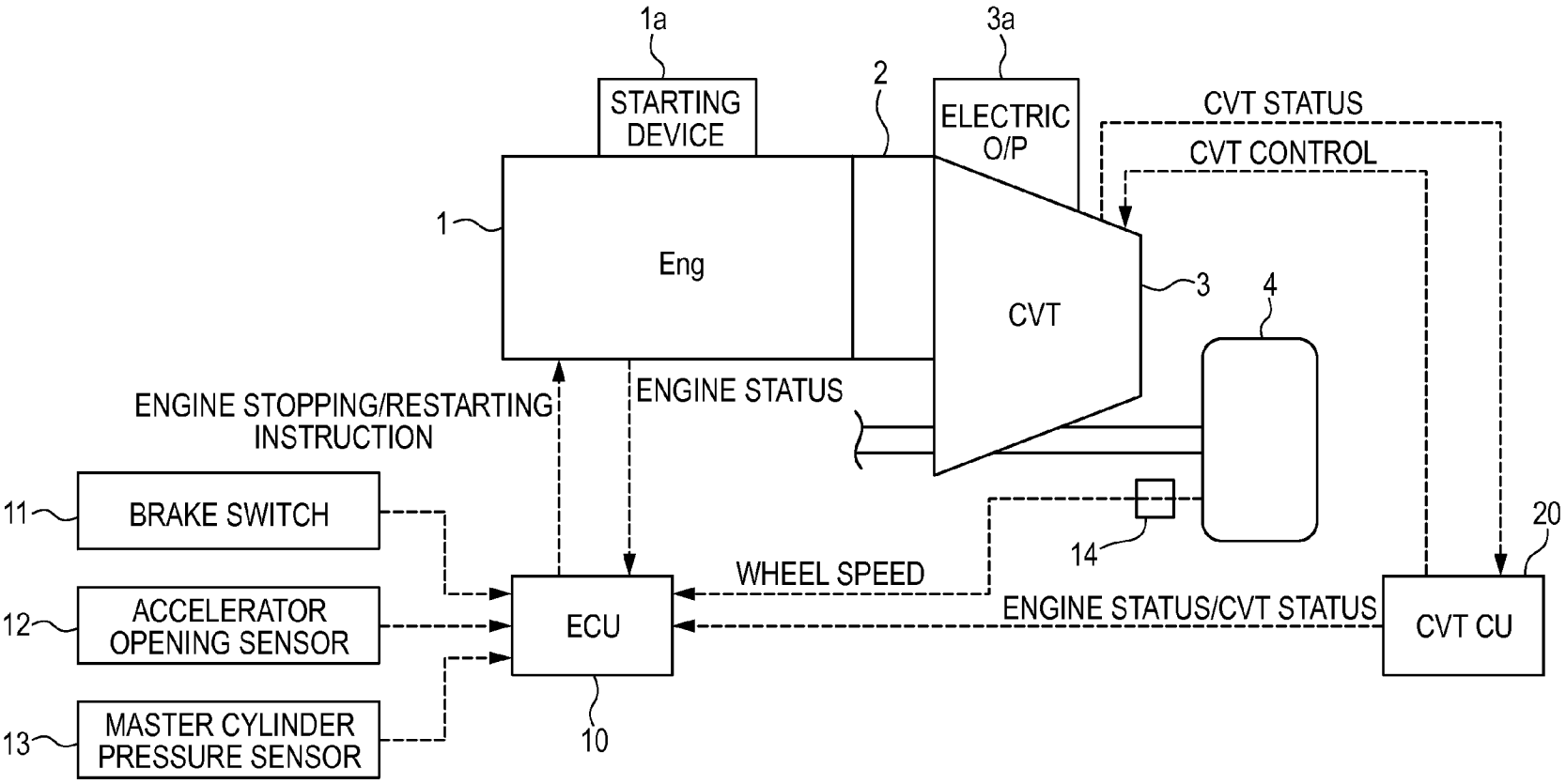
FIG. 1 is a system chart illustrating a drive system of a vehicle according to a first embodiment.

1 Engine
1*a* Engine starting device
2 Torque converter
3 Belt-type continuously variable transmission
3*a* Electric oil pump
4 Driving wheel
10 Engine control unit
11 Brake switch
12 Accelerator opening sensor
13 Master cylinder pressure sensor
14 Wheel speed sensor
20 CVT control unit
21 Starter motor
22 Battery
23 Resistor
24 Bypass relay
25 Rush current suppression circuit
26 Normally close contact (relay contact)
27 Driving relay (control means)
28 Normally open contact
29 Controller (control means)
30 Current supply path
31 Coil relay

DESCRIPTION OF EMBODIMENTS

Hereinafter, an explanation will be given to an aspect for implementing an engine starting device of an idle reduction vehicle according to the present invention, with reference to an embodiment illustrated in the drawings.

First Embodiment

First, the structure of the first embodiment will be explained.

FIG. 1 is a system chart illustrating a drive system of a vehicle according to the first embodiment. A rotary driving force that is inputted from an engine 1 is inputted via a torque converter 2 into a belt-type continuously variable transmission 3, where its speed is changed according to a desired gear ratio, and transmitted to a driving wheel 4.

The engine 1 includes an engine starting device 1*a* for starting the engine. Specifically, it is provided with a starter motor, which cranks the engine and injects fuel based on an engine starting instruction and, when the engine 1 is able to make self-sustaining rotation, stops the starter motor.

On the output side of the engine 1, a torque converter 2 including a lock-up clutch that amplifies torque in a stopping speed region and that prohibits relative rotation at a predetermined vehicle speed (about 14 km/h, for example) or more is provided. On the output side of the torque converter 2, the belt-type continuously variable transmission 3 is connected.

The belt-type continuously variable transmission 3 is formed by a starting clutch, a primary pulley, a secondary pulley, and a belt that is hung across the pulleys, and achieves the desired gear ratio by changing a pulley groove width by hydraulic control. An oil pump that is driven by the engine 1 is provided in the belt-type continuously variable transmission 3. When the engine is operated, converter pressure and lock-up clutch pressure of the torque converter 2 are supplied, and pulley pressure and clutch engaging pressure of the belt-type continuously variable transmission 3 are supplied, by using the oil pump as a hydraulic pressure source.

Further, an electric oil pump 3*a* is provided in the belt-type continuously variable transmission 3. The electric oil pump 3*a* is configured to operate when the hydraulic pressure cannot be supplied by the oil pump due to an automatic stop of the engine, and to be able to supply the necessary hydraulic pressure to respective actuators. Thus, it is possible to achieve the desired gear ratio and to maintain the clutch engaging pressure even when the engine is stopped.

An operation status of the engine 1 is controlled by an engine control unit 10. Signals including a brake signal from a brake switch 11 that outputs an ON signal by brake pedal operation of a driver, an accelerator signal from an accelerator opening sensor 12 that detects an accelerator pedal operation amount of the driver, a brake operation amount signal (master cylinder pressure) from a master cylinder pressure sensor 13 that detects the master cylinder pressure generated based on a brake pedal operation amount, a wheel speed signal from a wheel speed sensor 14 that is provided in each wheel, a CVT status signal from a later-described CVT control unit 20, signals of an engine water temperature, a crank angle, an engine speed and the like are inputted into the engine control unit 10. Based on the various signals as described above, the engine control unit 10 starts or automatically stops the engine 1. It should be noted that, instead of the master cylinder pressure sensor 13, a pedal force sensor for detecting a brake pedal stroke amount or a brake pedal tread force, or a sensor for detecting wheel cylinder pressure may be used to detect the brake pedal operation amount, so as to detect driver's braking intent.

The CVT control unit 20 transmits/receives signals of an engine operation status and a CVT status to/from the engine control unit 10 and, based on the signals, controls the speed ratio of the belt-type continuously variable transmission 3 and the like. Specifically, when the driving range is being chosen, the starting clutch is engaged, the speed ratio is determined from a speed ratio map based on an accelerator pedal opening and the vehicle speed, and the hydraulic pressure of each of the pulleys is controlled. In addition, when the vehicle speed is less than a predetermined vehicle speed, the lock-up clutch is released, and when the vehicle speed is the predetermined vehicle speed or more, the lock-up clutch is engaged, so as to directly couple the engine 1 to the belt-type continuously variable transmission 3. Furthermore, when the engine is stopped automatically while the driving range is being chosen, the electric oil pump 3*a* is operated so as to secure the necessary hydraulic pressure.

[Idle Reduction Control]

Next, idle reduction control in the engine control unit 10 will be explained.

The engine control unit 10 stops the engine 1 automatically when a predetermined engine stopping condition is satisfied, and restarts the engine 1 by operating the starter motor 21 (refer to FIG. 2) when a predetermined engine restarting condition is satisfied, that is, engine control unit 10 makes the so-called idle reduction control.

The engine stopping condition of the idle reduction control means, for example, the case when all the following four conditions are satisfied, and the engine restarting condition means the case where either one of the four conditions is not satisfied.

1. The brake switch 11 is ON.
2. The accelerator pedal operation amount is zero.
3. The driving range (D range) is being chosen.
4. The vehicle speed continues to be zero for a predetermined period of time.

[Engine Starting Device]

Figure 2:
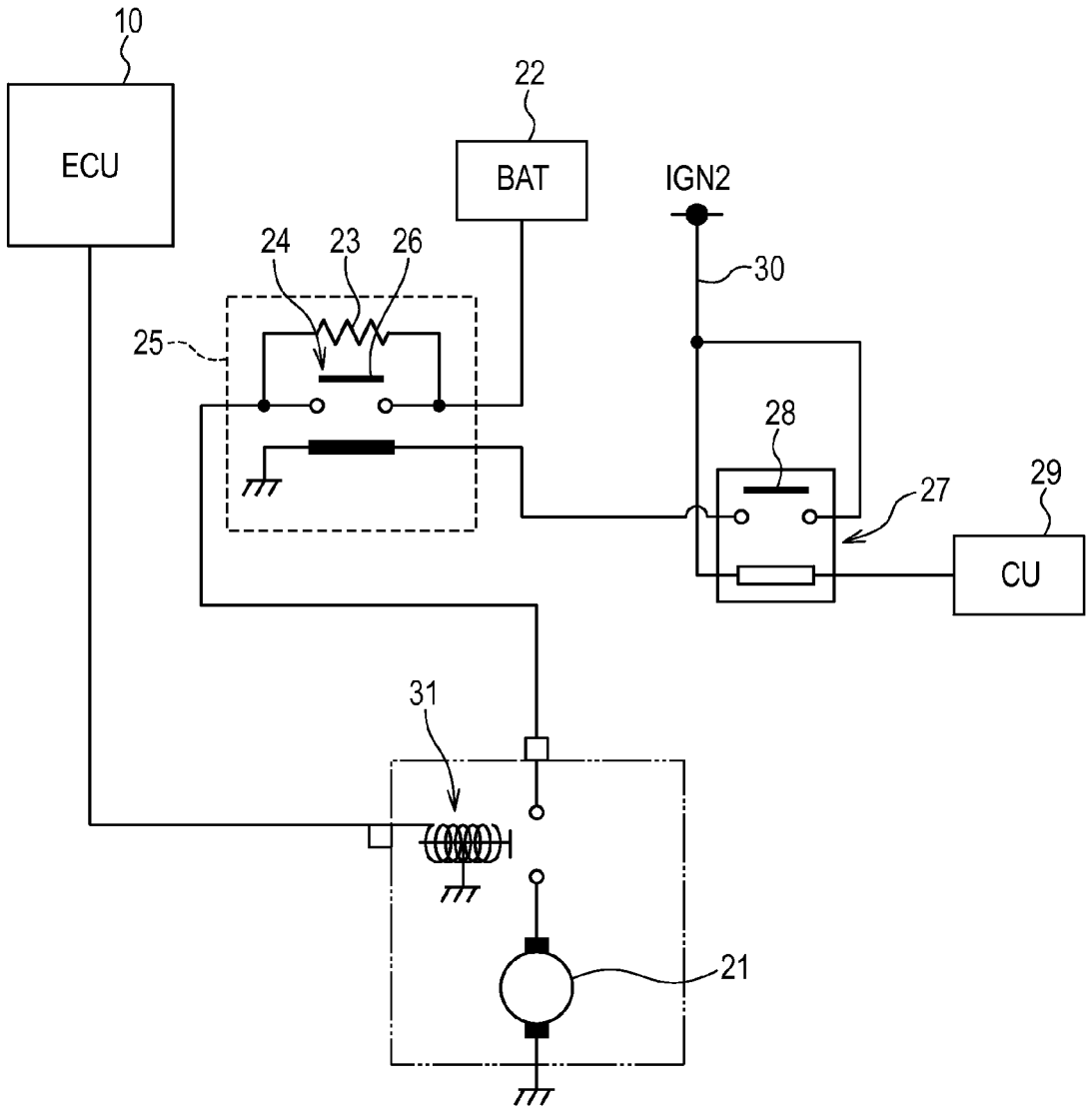
FIG. 2 is a circuit diagram of an engine starting device 1*a* according to the first embodiment.

FIG. 2 is a circuit diagram of the engine starting device 1*a* according to the first embodiment.

An output shaft of a starter motor 21 is connected to the engine 1 via a belt that is not illustrated.

A battery 22 supplies a DC current to the starter motor 21.

A rush current suppression circuit 25, in which a resistor 23 and a bypass relay 24 are connected in parallel, is interposed between the battery 22 and the starter motor 21. The resistor 23 is to reduce the current flowing into the starter motor 21 to a predetermined value or less, at the time of restarting the engine after the idle reduction control.

The bypass relay 24 includes a normally close contact (relay contact) 26, and operates (opens the contact) by a current supplied from a driving relay 27.

The driving relay 27 includes a normally open contact 28, and operates (closes the contact) by an instruction from a controller 29. When the normally open contact 28 of the driving relay 27 is closed, a current is supplied from a current supply path 30 to the bypass relay 24. The driving relay 27 and the controller 29 form a control means.

When an ignition key switch (not illustrated) is set at an ON position, the controller 29 outputs the instruction to close the normally open contact 28 to the driving relay 27 so as to supply the current from the current supply path 30 to the bypass relay 24, and outputs the instruction to open the normally open contact 28 after a lapse of a predetermined period of time so as to interrupt the current supply to the bypass relay 24. Here, the predetermined period of time means, for example, the period while the engine 1 is assumed to pass over the first top dead center.

The current supply path 30 is connected to an IGN2 line. The IGN2 line is the path to which the current is supplied from the battery 22, when the ignition key switch is set at the ON position, and to which the current supply from the battery 22 is interrupted when the ignition key switch is set at an engine start position ST. In addition to the current supply path 30, electronic parts (an air conditioner, an instrument and the like, for example) whose operation is required while the engine is operated, and whose operation is not required at the time of starting the engine based on key operation of the driver (when the engine is started for the first time based on the operation of the driver) are connected to the IGN2 line.

A coil relay 31 that is turned on/off by the engine control unit 10 is provided between the battery 22 and the starter motor 21 and at the position closer to the starter motor 21 side than the resistor 23 and the rush current suppression circuit 25. When the ignition key switch is set at the engine start position ST and when a restarting request of the engine 1 by the idle reduction control is made, the engine control unit 10 turns on the coil relay 31, and supplies the current from the battery 22 to the starter motor 21, so as to drive the starter motor 21, during a period until when the engine speed reaches a set value (cranking rotation speed, for example).

Next, the function will be explained.

Figure 3:
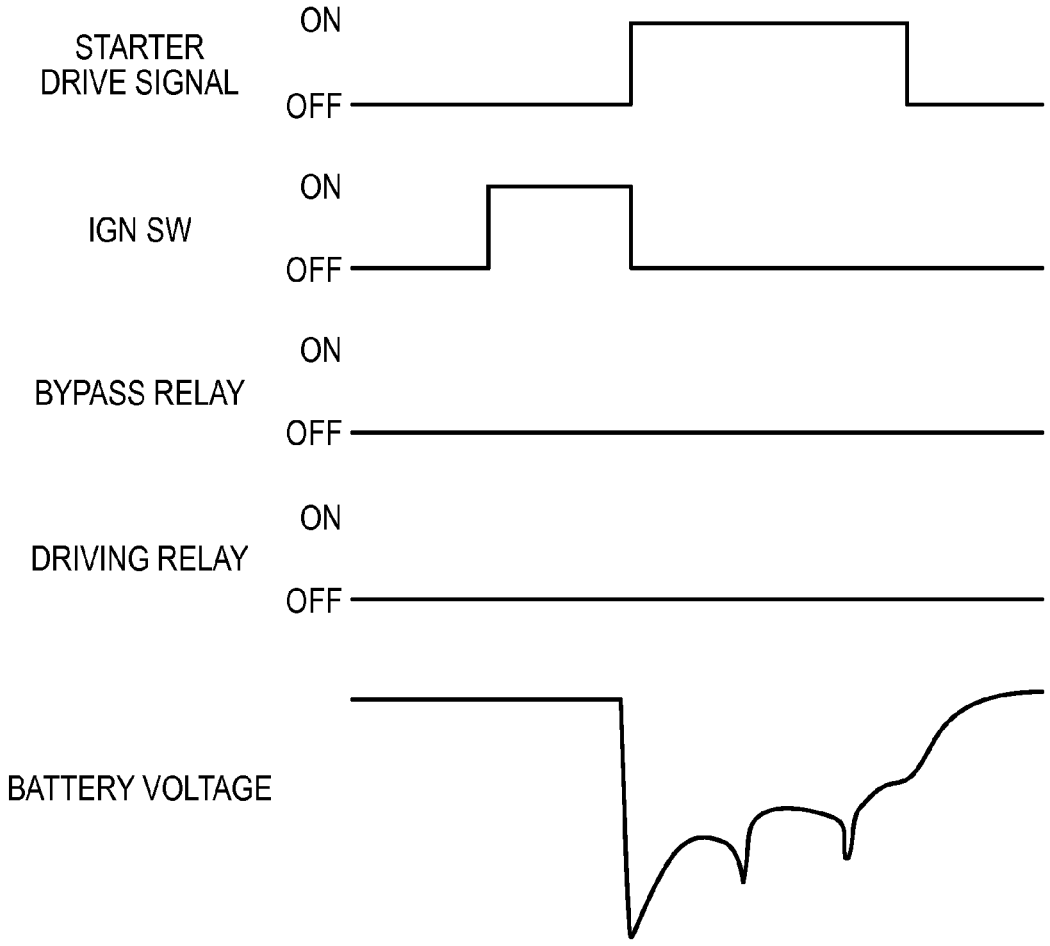
FIG. 3 is a time chart illustrating the operation of the engine starting device 1*a* when the engine is started for the first time under a normal temperature environment.

FIG. 3 is a time chart illustrating the operation of the engine starting device 1*a* when the engine is started for the first time under a normal temperature environment. When the engine is started for the first time, the ignition key switch is set at the engine start position ST, and thus the driving relay 27 is kept OFF and the bypass relay 24 is kept OFF (closed state). Therefore, the resistor 23 of the rush current suppression circuit 25 is short-circuited.

Figure 4:
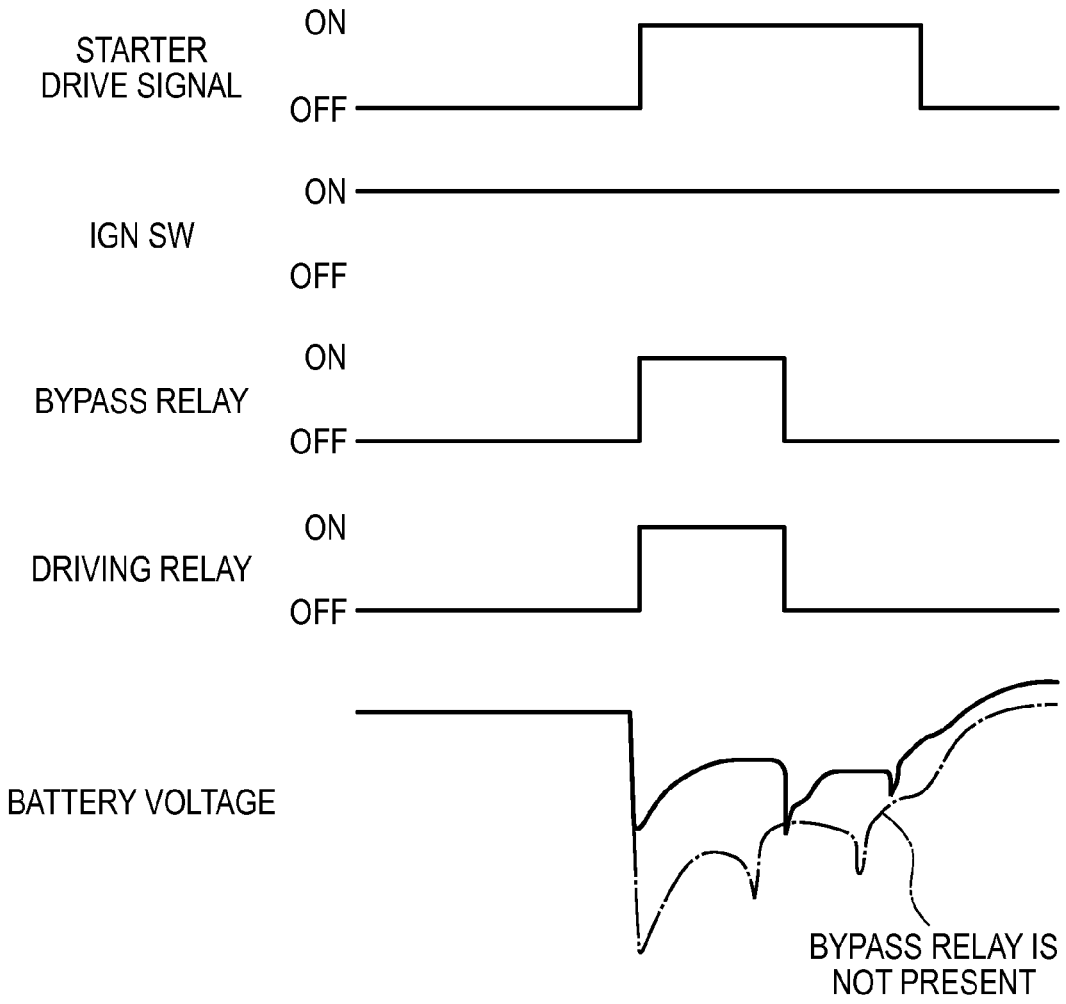
FIG. 4 is a time chart illustrating the operation of the engine starting device 1*a* when the engine is restarted under the normal temperature environment.

FIG. 4 is a time chart illustrating the operation of the engine starting device 1*a* when the engine is restarted under the normal temperature environment. When the engine is restarted, the ignition key switch is set at the ON position, and thus the driving relay 27 is turned ON for a predetermined period of time, and the bypass relay 24 is turned ON (open state) for the predetermined period of time. Therefore, a starting current of the starter motor 21 is supplied via the resistor 23 to the starter motor 21. Thereby, a voltage drop of the battery 22 can be suppressed as compared with the case where the bypass relay 24 is not present, and hence, the influence on the electronic parts and the like that are mounted on the vehicle can be reduced.

As the driving relay 27 is turned OFF and the bypass relay 24 is turned OFF (closed state) after a lapse of the predetermined period of time, the resistor 23 of the rush current suppression circuit 25 is short-circuited. This facilitates a shift to a cranking state in a favorable manner, similarly to the conventional engine starting devices.

Figure 5:
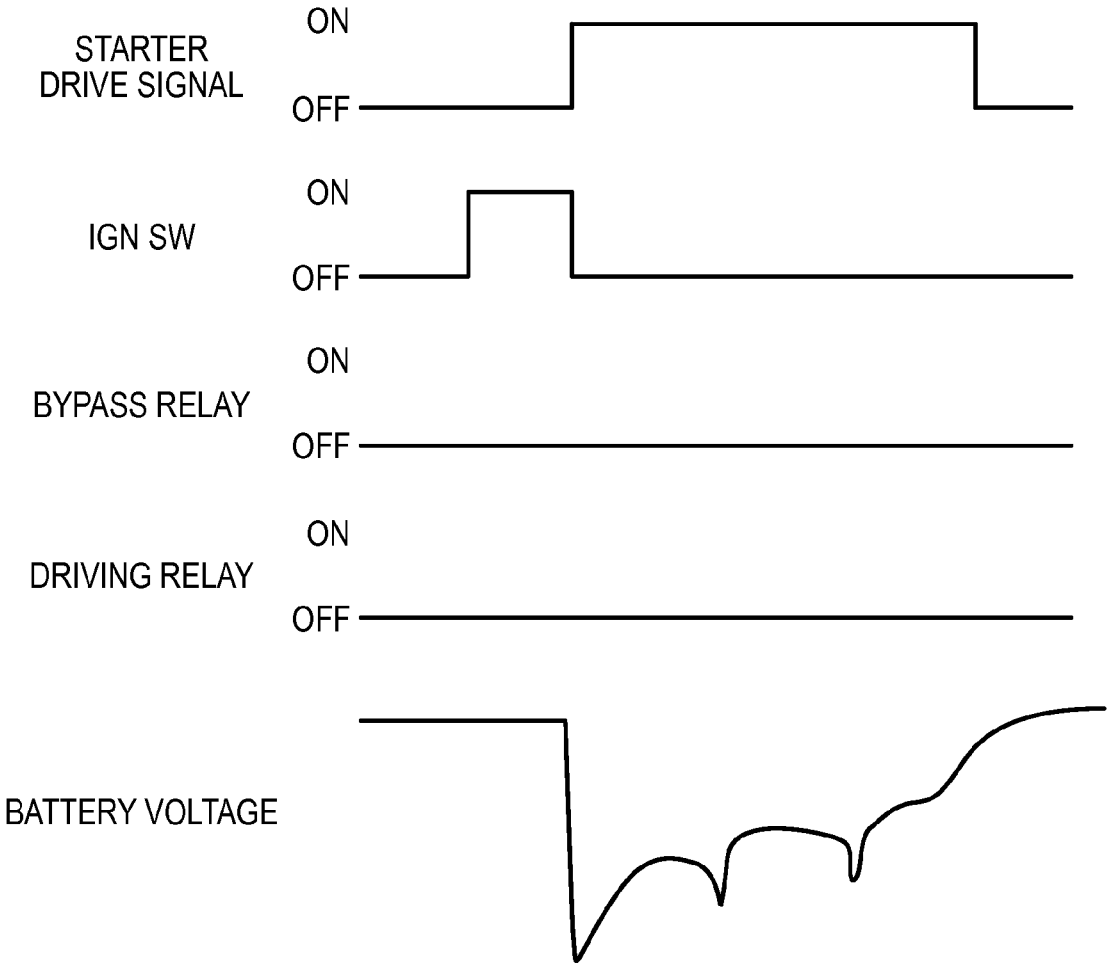
FIG. 5 is a time chart illustrating the operation of the engine starting device 1*a* when the engine is started for the first time under a low temperature environment (normal condition)

FIG. 5 is a time chart illustrating the operation of the engine starting device 1*a* when the engine is started for the first time under a low temperature environment (normal condition). Although the operation similar to that under the normal temperature environment is made under the low temperature environment, engine friction is increased as compared with the engine friction under the normal temperature, which results in poor startability and longer starting time.

Figure 6:
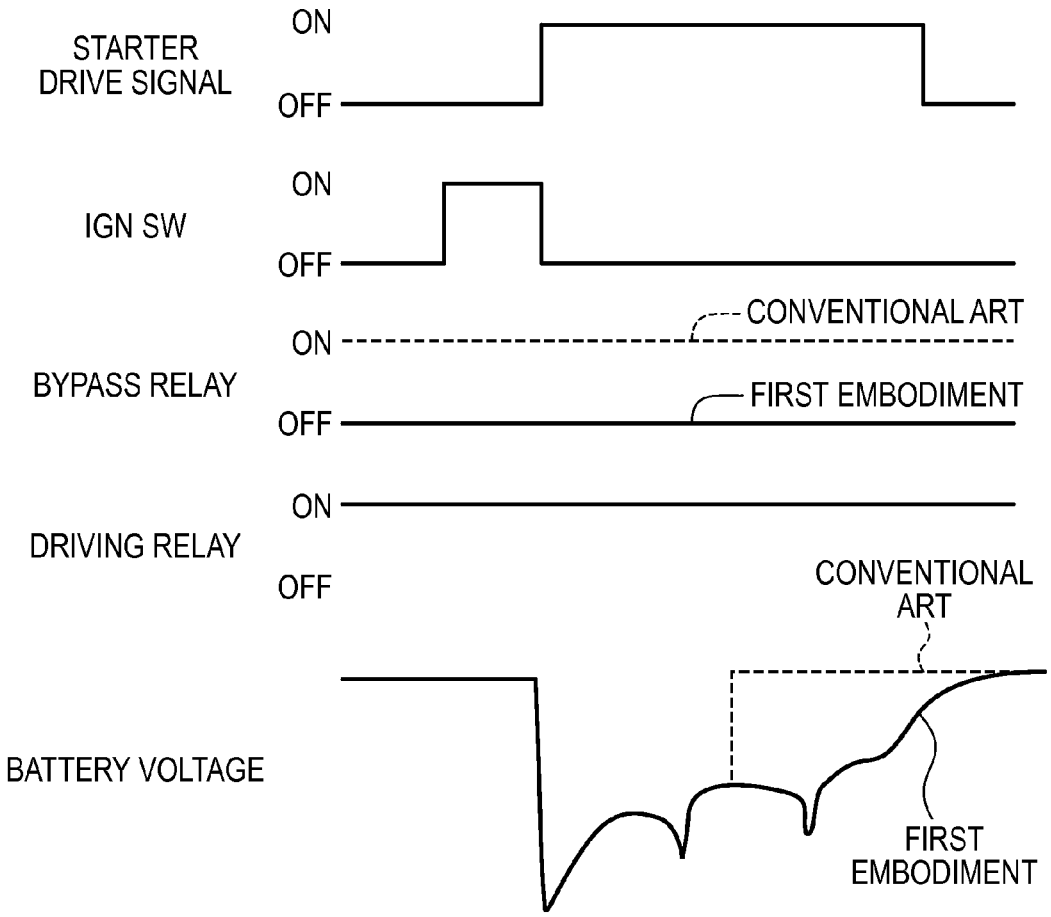
FIG. 6 is a time chart illustrating the operation of the engine starting device 1*a* when the engine is started for the first time under the low temperature environment (failure condition).

FIG. 6 is a time chart illustrating the operation of the engine starting device 1*a* when the engine is started for the first time under the low temperature environment (failure condition). It is the example when the driving relay 27 is stuck closed or when the controller 29 keeps outputting an erroneous instruction to close the normally open contact 28 to the driving relay 27.

When the bypass relay is stuck open due to the driving relay being stuck closed and the erroneous instruction from the controller, according to the conventional engine starting devices, there is a possibility that the resistor is burnt out due to a large current flow through the resistor for a long period of time, especially under the low temperature environment where the engine start requires a longer period of time. A broken line of the battery voltage in FIG. 6 illustrates the state where the resistor is burnt out and the starter motor is stopped before the engine start is completed.

Meanwhile, with the engine starting device 1*a* according to the first embodiment, the current supply to the current supply path 30 is interrupted when the engine is started for the first time and therefore, the current is not supplied to the driving relay 27. Even when the bypass relay 24 is to be energized because of the driving relay 27 being stuck closed or the failure of the controller 29, the current is not supplied to the bypass relay 24 and the bypass relay 24 remains OFF (closed state). As the resistor 23 of the rush current suppression circuit 25 is short-circuited, it is possible to prevent the large current from flowing through the resistor 23 for a long period of time, and to prevent the burning out of the resistor 23.

Meanwhile, when the engine is restarted after the idle reduction, the current is supplied to the driving relay 27. Therefore, when the driving relay 27 is stuck closed, the current is supplied to the bypass relay 24 and the bypass relay 24 is turned ON (open state). However, when the engine is restarted, the engine 1 is already warmed up, and has less engine friction as compared with the case when the engine is started for the first time. Thus, as the restarting time of the engine is sufficiently short as compared to the time when the engine is started for the first time, there is no possibility that the resistor 23 is burnt out.

With the engine starting device 1*a* according to the first embodiment, the current supply path 30 is connected to the IGN2 line. As the IGN2 line is provided in the existing vehicles, it is possible to realize the structure, in which the current is supplied to the driving relay 27 when the engine is restarted after the idle reduction, and the current supply to the driving relay 27 is interrupted when the engine is started for the first time based on the operation of the driver, without adding components, and to suppress a cost increase.

With the above-described engine starting device of the idle reduction vehicle according to the first embodiment, the following effects can be obtained.

(1) An engine starting device of an idle reduction vehicle that automatically stops an engine 1 when a predetermined engine stopping condition is satisfied and that restarts the engine 1 by operating a starter motor 21 when a predetermined engine restarting condition is satisfied, includes: a resistor 23 that is arranged in series between the starter motor 21 and a battery 22; a bypass relay 24 that is arranged in parallel to the resistor 23 and that has a structure of a normally close contact maintaining a normally closed contact 26 in an open state by energization; and a control means (a driving relay 27 and a controller 29) that controls whether or not a supplied current is supplied to the bypass relay 24 for the energization, in which the current is supplied to the control means when restarting the engine after idle reduction, and the current supply to the control means is interrupted when the engine is started initially based on operation of a driver.

Thus, it is possible to prevent both of power shutdown of the electronic parts and burning out of the resistor 23 when restarting the engine after the idle reduction.

(2) The control means is connected to an IGN2 line that is identical to the IGN2 line connected to an electronic part, to which a current is supplied from the battery 22 when an ignition switch is on, and the current supply from the battery 22 is interrupted when the engine is started initially based on the operation of the driver.

As the IGN2 line is provided in the existing vehicles, it is possible to realize the structure, in which the current is supplied to the driving relay 27 when the engine is restarted after the idle reduction, and the current supply to the driving relay 27 is interrupted when the engine is started for the first time based on the operation of the driver, without adding components, and to suppress a cost increase.

Other Embodiments

The aspect for implementing the present invention has been explained thus far based on the embodiment, but the structure of the present invention is not limited to the embodiment. For example, the engine stopping condition of the idle reduction control is not limited to the case when all the four conditions are satisfied, as illustrated in the embodiment, but may be the case when the two or three conditions are satisfied. Moreover, other conditions may be added.

The invention claimed is:

1. An engine starting device of an idle reduction vehicle that automatically stops an engine when a predetermined engine stopping condition is satisfied and that restarts the engine by operating a starter motor when a predetermined engine restarting condition is satisfied, the engine starting device comprising:

a resistor that is arranged in series between the starter motor and a battery;

a bypass relay that is arranged in parallel to the resistor and that has a structure of a normally closed contact maintaining a relay contact in an open state by energization;

a current supply path to which a current is supplied from the battery when an ignition switch is on, and to which a current supply from the battery is interrupted when the engine is started initially based on operation of a driver; and a control unit configured to control whether or not a current is supplied from the current supply path to the bypass relay for the energization.

2. The engine starting device of the idle reduction vehicle according to claim 1, wherein the current supply path is connected to an electronic part, a current is supplied from the battery to the electronic part when the ignition switch is on, and a current supply from the battery to the electronic part is interrupted when the engine is started initially based on the operation of the driver.

* * * * *